US006575217B2

(12) United States Patent
Gnan et al.

(10) Patent No.: US 6,575,217 B2
(45) Date of Patent: Jun. 10, 2003

(54) DEVICE FOR SPLICING WEBS FOR MANUFACTURING CORRUGATED CARDBOARD

(75) Inventors: Alfons Gnan, Vilseck (DE); Edmund Bradatsch, Weiden (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 77 days.

(21) Appl. No.: 09/791,469

(22) Filed: Feb. 23, 2001

(65) Prior Publication Data

US 2001/0018953 A1 Sep. 6, 2001

(30) Foreign Application Priority Data

Feb. 24, 2000 (DE) ..... 100 08 612

(51) Int. Cl.[7] ..... B65H 21/00

(52) U.S. Cl. ..... 156/504; 156/502; 156/157; 242/551; 242/552

(58) Field of Search ..... 156/157, 159, 156/502, 504; 242/551, 552, 556.1

(56) References Cited

U.S. PATENT DOCUMENTS

| | | | | | |
|---|---|---|---|---|---|
| 1,724,225 | A | * | 8/1929 | Scott | 242/551 |
| 3,654,035 | A | * | 4/1972 | Takimoto | 156/502 |
| 6,397,915 | B1 | * | 6/2002 | Amaranti et al. | 156/157 |

FOREIGN PATENT DOCUMENTS

| | | | | | |
|---|---|---|---|---|---|
| CH | 672303 | A5 | | 11/1989 | |
| DE | 2301515 | | | 7/1973 | |
| DE | 2853051 | A1 | | 6/1980 | |
| DE | 30 39 293 | A | | 4/1981 | |
| DE | 3829931 | A1 | | 3/1989 | |
| DE | 3912328 | A1 | | 10/1989 | |
| EP | 0453727 | A2 | | 2/1991 | |
| EP | 0 847 974 | A | | 6/1998 | |
| FR | 2467807 | | | 10/1980 | |
| GB | 260 049 | A | | 10/1926 | |
| GB | 844442 | | * | 8/1960 | 156/504 |
| GB | 2 135 282 | A | | 8/1984 | |
| JP | 55-89151 | | * | 7/1980 | 156/157 |
| WO | WO 98/41464 | | * | 9/1998 | |

* cited by examiner

*Primary Examiner*—Mark A. Osele
(74) *Attorney, Agent, or Firm*—Russell D. Culbertson; Shaffer & Culbertson, L.L.P.

(57) ABSTRACT

The invention pertains to a device for splicing webs, in particular, paper webs for manufacturing corrugated cardboard, with a splicing unit (9) for preparing and splicing the rear end of a nearly empty active roll ($5_{akt}$) to the front end of a web ($5_{spl}$) to be spliced, and with the splicing unit (9) containing one respective intake (11) for the active web ($5_{akt}$) and for the web ($5_{spl}$) to be spliced. The device also contains a web unrolling device (13) that serves for accommodating several web rolls (21), with the web unrolling device (13) being constructed in such a way that it is able to accommodate at least three web rolls (21) such that a first web of the three webs delivered from the web rolls (21) can serve as the active web ($5_{akt}$), a second web of the three webs (21) can serve as the web ($5_{spl}$) to be spliced to the active web and the third web roll (21) can be simultaneously exchanged and/or the web in question can be prepared for the next splicing process.

14 Claims, 3 Drawing Sheets

9
11
13
21
I
II
III
5akt
5spl

DEVICE FOR SPLICING WEBS FOR MANUFACTURING CORRUGATED CARDBOARD

TECHNICAL FIELD OF THE INVENTION

The invention pertains to a device for splicing webs, in particular, paper webs for manufacturing corrugated cardboard, as well as a device for manufacturing corrugated cardboard by gluing together at least two webs with such a splicing device.

BACKGROUND OF THE INVENTION

In known splicing devices as described, for example, in EP-B-0 453 727, a web unrolling device which consists of a stand that can be mounted on the floor and contains two lateral carrying arms for each web roll is assigned to the splicing device. The paper web in question is unrolled from the respectively active web roll. The paper web is transported through the splicing device which, except during the splicing process, is inactive and then transported to additional processing stations. When the end of the respectively active web roll is reached or a splicing process is necessary for different reasons, e.g., due to a format or quality change, the paper web of the active web roll is cut off in the splicing device and connected (spliced) to the front end of the paper web of the respectively other web roll which was prepared in the required fashion. In this case, the front end of the paper web to be spliced is inserted into the splicing device, preferably while the active web roll is still being processed, whereafter the front end of the paper web is cleanly cut off and provided with a (double-sided) adhesive tape. The splicing device is usually realized in such a way that it contains a web reservoir which makes it possible to store such a length of the active web, the end of which is almost reached, that the time required for cutting the initially active paper web and connecting the rear end of this paper web to the already prepared front end of the paper web to be spliced can be bridged. A continuous operation of the system for additionally processing the paper web in question can be ensured in this fashion.

If necessary, the tube on which the previously active paper web was wound, or the rest of this paper roll can be removed from the respective lateral carrying arm of the web unrolling device and replaced with a new web roll that, if necessary, may also have a different quality or width.

The removal of the winding tube or the depleted web roll from the respective carrying arm and its replacement with a new web roll is a relatively time-consuming process. The production time, within which a constant format or a constant quality is produced, may be shorter than the time required for the removal of one web roll and its replacement with a new web roll, in particular, in corrugated cardboard systems, in which frequent format and/or quality changes are necessary. In known splicing devices, this results in standstill times that, in turn, have negative effects on the productivity of the entire system.

This is the reason why web unrolling devices or web feeders were developed which allow an exchange of the web roll within the shortest possible time. A device of this type is, for example, described in DE-A-39 12 328.

However, the measures disclosed in DE-A-39 12 328 only make it possible to reduce the time for replacing the web roll on the respective carrying arm to a certain degree. In certain systems, in particular, special systems for processing very small orders, this time may still be excessively long for ensuring an optimal productivity of the entire system.

SUMMARY OF THE INVENTION

Based on this state of the art, the invention aims to develop a device for splicing webs, in particular, paper webs for manufacturing corrugated cardboard which also ensures an optimal productivity of the entire system into which the splicing device is integrated, when processing very small orders. Another objective of the invention consists of developing a device for manufacturing corrugated cardboard by gluing together at least two webs, into which device such a splicing device is advantageously integrated.

The invention starts from the recognition that the productivity of a system for processing webs, e.g., a corrugated cardboard system, in which splicing processes must be carried out within relatively short intervals, can be significantly increased if a conventional splicing device with two intakes for the webs to be spliced contains a web unrolling device that is able to accommodate at least three web rolls. Due to this measure, it is possible to unroll the respectively active web (i.e., the web currently being processed by the system) from a first web roll that is held in the web unrolling device and transport this web to the additional system via the splicing device. The front end of a second web that is held in the web unrolling device can already be prepared for the next splicing process, transported to the respectively other intake of the splicing device and held therein until the next splicing process is carried out. If so required, an exchange of the web roll in question may already take place in the third position of the web unrolling device such that, in theory, the front end of this third web can be transported to the intake of the splicing device which has become available after the splicing process was carried out (i.e., the intake, through which the respectively active web was supplied before the splicing process was carried out) immediately after the splicing process of the two webs that are simultaneously supplied to the splicing device has taken place. Consequently, the time between two splicing processes can be reduced to a minimum which is defined by the preparation and insertion of the front end of the web to be spliced. Due to the additionally provided stand-by web roll, this time is not dependent on the time required for exchanging this web roll.

According to one embodiment, the web unrolling device may be constructed in such a way that the web of a web roll can, depending on the respective requirements, be transported to either of the two intakes of the splicing device. This provides the advantage that the shortest possible time for a splicing process can be achieved in any case, independently of the web rolls from which the webs to be spliced are supplied to the splicing device.

In this case, it is usually necessary to provide one or more deflection rollers for transporting the respective web to one or the other intake of the splicing device. The seating positions of the web rolls in the web unrolling device may lie vertically on top of one another, preferably centrally with respect to the horizontal orientation of the splicing device. Although this results in a relatively large structural height, only a minimal quantity of deflection rollers or, in the most favorable instance, no deflection rollers at all, are required for transporting a web from any of the three web roll positions to either of the two intakes.

According to another embodiment of the invention, the transport of the webs to the splicing device may take place in such a way that the webs of both web rolls which are situated in two given positions of the web unrolling device can be alternately transported to only one of the two intakes of the splicing device. This simplifies the design of the web unrolling device. Only a minimal quantity of deflection rollers or no deflection rollers at all are required for transporting the webs to the intakes of the splicing device. In particular, it is possible to utilize conventional web unrolling devices that are able to accommodate only two web rolls. In contrast to known splicing devices, such a conventional web unrolling device is, however, only assigned to one intake of the splicing device.

Another option consists of utilizing a conventional splicing device with a conventional web unrolling device that has two web roll positions, with each position of the conventional web unrolling device being respectively assigned to one intake of the splicing device, and with one additional unrolling unit for accommodating an additional web roll being assigned to one or both intakes of the splicing device.

As mentioned previously, it would naturally also be possible to assign two positions for web rolls of the entire web unrolling device to each of the two intakes or only one. If this is realized for only one of the two intakes, a "fast splicing process" is only possible on one of the two sides of the splicing device.

A device for manufacturing corrugated cardboard by gluing together at least two webs may be realized in such a way that a splicing device of the previously described type is assigned to each of the two webs to be glued together.

The device for manufacturing corrugated cardboard may, for example, be realized in such a way that conventional splicing devices with one respective web unrolling device for two web rolls are utilized, with another conventional web unrolling device with two positions for two web rolls being provided between the splicing devices that are preferably arranged horizontally adjacent to one another. Each of the two positions can then be assigned to the respectively adjacent splicing device or to the adjacent intake of the respective splicing device.

These and other objects, advantages, and features of the invention will be apparent from the following description of the preferred embodiments, considered along with the accompanying drawings.

DESCRIPTION OF THE PREFERRED EMBODIMENTS

Figure 1:
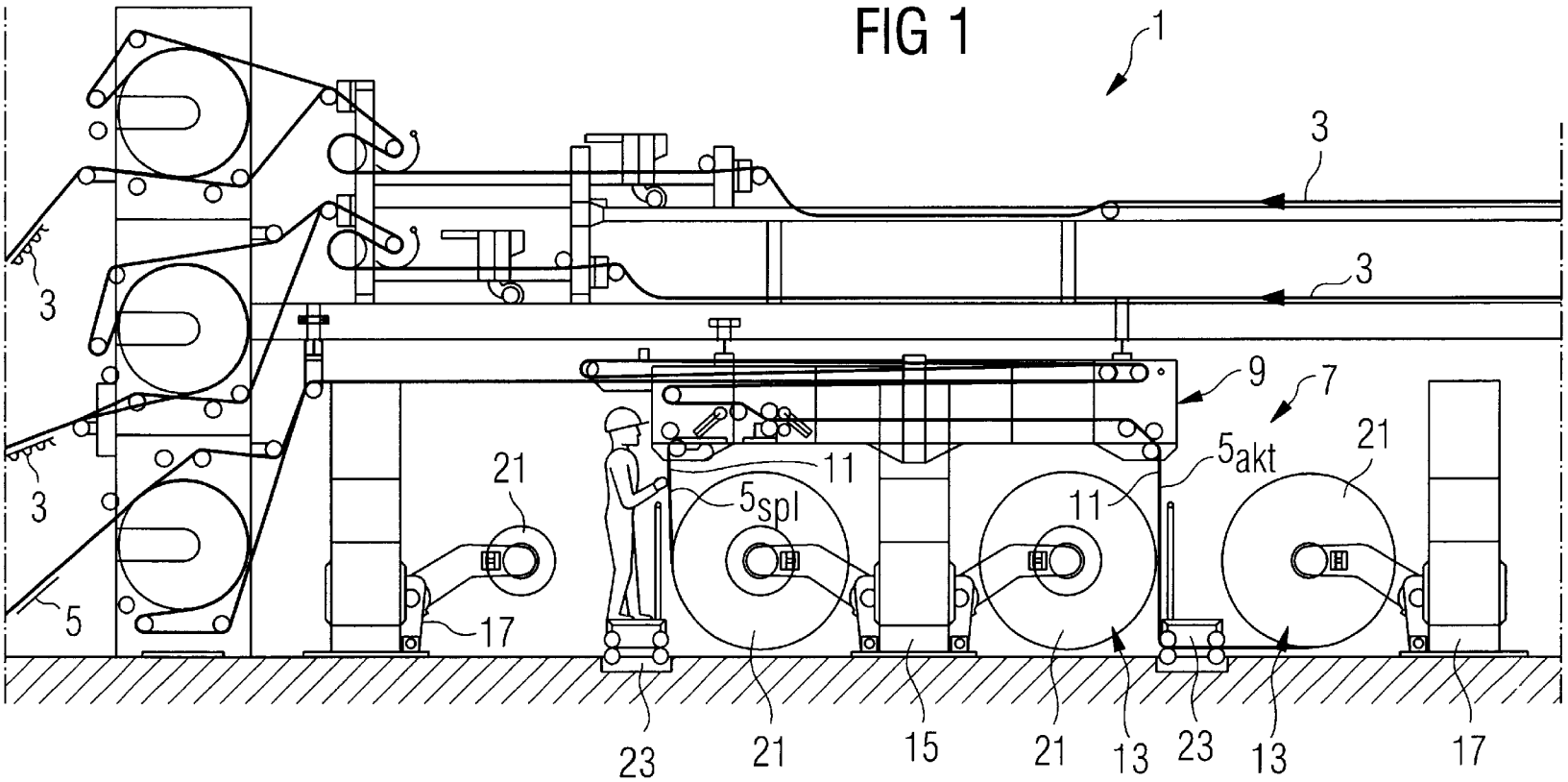
FIG. 1 is a detail of a corrugated cardboard system with a splicing device according to the invention.

The corrugated cardboard system 1, a section of which is shown in FIG. 1, makes it possible to manufacture double-sided corrugated cardboard, wherein two one-sided corrugated cardboard webs 3 and a cover strip 5 are glued together. The two one-sided corrugated cardboard webs are supplied to the portion of the corrugated cardboard system which is shown in FIG. 1 in the direction indicated by the arrow (from the right to the left).

The splicing device 7 shown in FIG. 1 serves for splicing webs for the cover strip 5. The splicing device 7 essentially consists of the splicing unit 9 that contains two intakes 11 for the two respective webs to be spliced. The splicing device 7 also contains a web unrolling device 13 with a conventional web unrolling unit 15 that is arranged underneath the splicing unit 9. The splicing unit 9 and the conventional web unrolling unit 15 consequently form a conventional, generally known splicing unit with two positions for web rolls.

The web unrolling device 13 also contains two web unrolling units 17 that respectively serve for accommodating only one web roll. In the embodiment shown in FIG. 1, the additional web unrolling units 17 are respectively arranged to the left and the right of the conventional splicing unit. This provides the advantage that already existing corrugated cardboard systems with conventional splicing units that respectively contain a web unrolling device for two web rolls can be retrofitted into a splicing unit according to the invention. This merely requires that two additional web unrolling units 17 be provided.

FIG. 1 indicates that the supply of the webs 5 from the web rolls 21 can be realized with the aid of one respective deflection unit 23. The deflection units 23 contain correspondingly arranged deflection rollers for transporting the respective web 5 from the web rolls 21 that are held in the web unrolling units 17 to the respective intake 11 of the splicing unit 9 underneath an operating platform.

FIG. 1 also shows that the operating platforms of the deflection units 23 are able to accommodate an operator who consequently is able to comfortably operate the system and transport the respective front end of the web 5 from the web rolls 21 of the web unrolling units 17 to the respective intake 11 of the splicing unit 9.

In the operating phase shown in FIG. 1, the web being unrolled from the web roll 21 that is held in the respective web unrolling unit 17 and shown on the right in FIG. 1 is transported to additional processing stations via the splicing device 7. Consequently, this web is referred to as the active web $\mathbf{5}_{akt}$. The operator transports the web 5 being unrolled from the web roll 21 that is held in the left position of the web unrolling unit to the respectively other (left) intake 11 of the splicing unit 9. This web is spliced to the currently active web $\mathbf{5}_{akt}$ during the next splicing process. Consequently, this web is also referred to as the web $\mathbf{5}_{spl}$ to be spliced.

The two remaining web rolls 21 which are respectively held in the left web unrolling unit 17 and in the right arm of the unrolling unit 15 are referred to as stand-by web rolls 21 below. In the operating phase shown in FIG. 1, the web roll 21 that is held in the right arm of the web unrolling unit 15 was already replaced with a new web roll. After the operator has prepared the web $\mathbf{5}_{spl}$ for the next splicing process, the nearly empty web roll 21 that is held in the left web unrolling unit 17 can be replaced with a new web roll 21. Naturally, this may also take place in a fully automated fashion by means of a suitable device.

In the embodiment of a splicing device which is shown in FIG. 1, it is possible to supply a web 5 to be spliced to both sides of the splicing device 7, i.e., to each intake 11 of the splicing unit 9, while the web roll held in the respective stand-by position can be replaced or the web roll in question is held in this position for use in the next splicing process.

Figure 2:
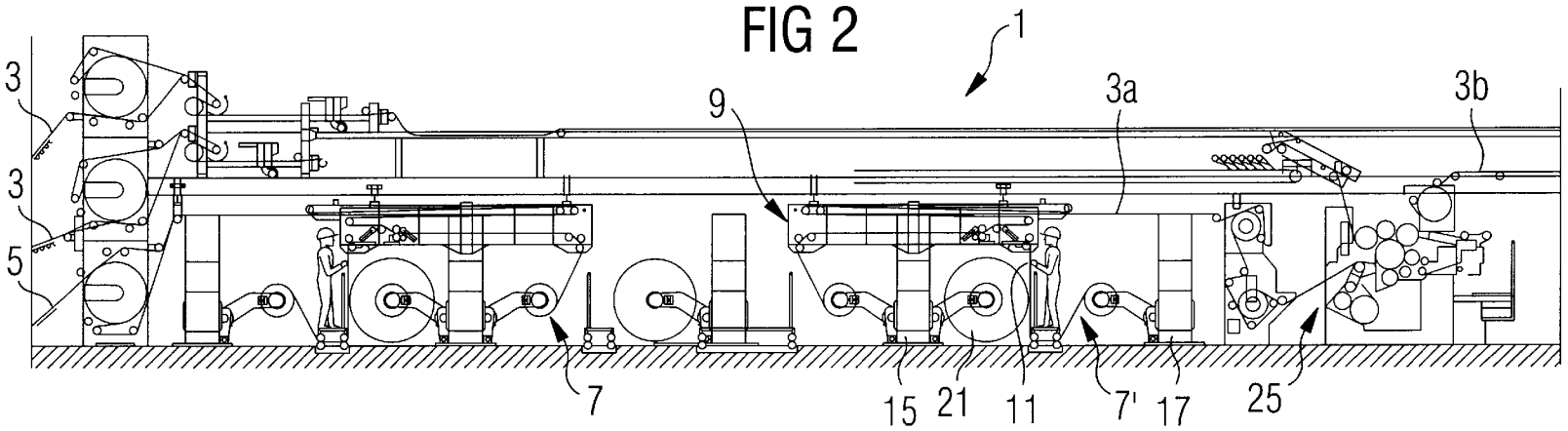
FIG. 2 is a larger detail of the corrugated cardboard system shown in FIG. 1 with two splicing devices according to the invention.

The larger section of the corrugated cardboard system 1 which is shown in FIG. 2 indicates two essentially identical splicing devices 7, with the splicing device 7' which is additionally shown in FIG. 2 being provided only with an additional web unrolling unit 17 on its right side, and with the position for a web roll of this additional web unrolling unit being assigned to the right intake 11 of the splicing unit 9. The splicing device 7' serves for splicing and supplying a partial web 3*a* to a one-sided corrugated cardboard machine 25 that processes the partial web 3*a* and one additional partial web 3*b* that is supplied from the right in FIG. 2 into a one-sided corrugated cardboard 3.

Since only one additional web unrolling unit 17 is assigned to the splicing unit 9, only every other splicing process can be "quickly executed" with the splicing device 7, namely the splicing processes, in which the web $\mathbf{5}_{spl}$ to be spliced is unrolled from a web roll 21 that is situated in the right position of the web unrolling unit 15 or in the position of the additional web unrolling unit 17.

However, since the externally visible cover strip 5 requires a more frequent quality change (and consequently more frequent splicing processes) than the remaining webs of the double-sided corrugated cardboard, this simplified embodiment of the splicing device 7' which is shown in FIG. 2 is entirely capable of realizing the required splicing processes without significantly influencing the productivity of the corrugated cardboard system 1.

Figure 3:
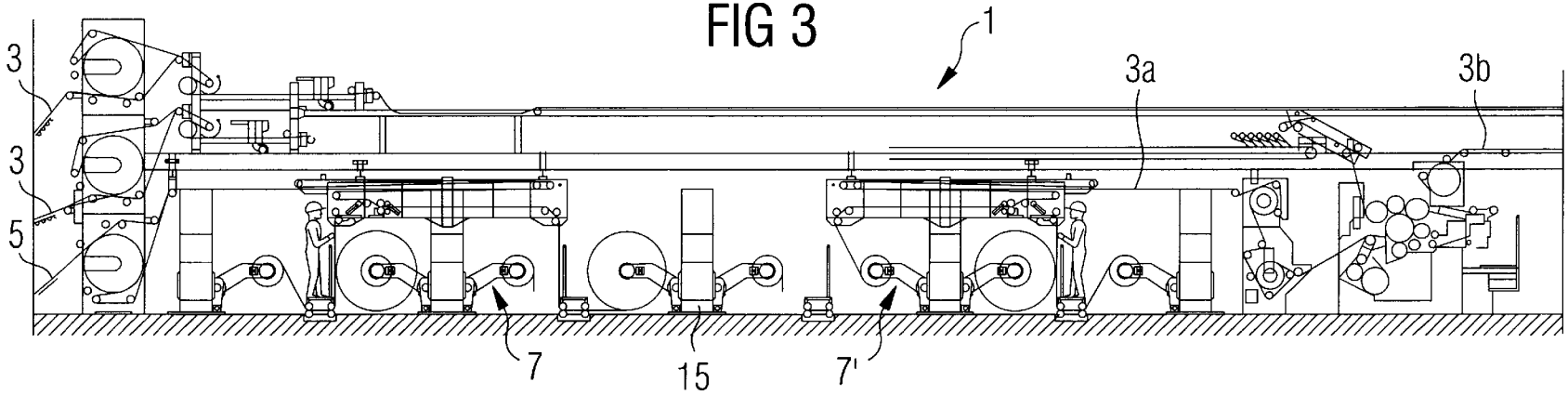
FIG. 3 is another embodiment of a corrugated cardboard system with two splicing devices according to the invention.

The embodiment of a corrugated cardboard system 1 which is shown in FIG. 3 differs from the embodiment shown in FIGS. 1 and 2 only in that two additional positions for web rolls 21 are assigned to the second splicing device 7' analogous to the splicing device 7. In comparison to the embodiment shown in FIG. 2, the additional web unrolling unit 17 which is shown on the right in FIG. 1 was merely replaced with a conventional web unrolling unit 15 with two lateral carrying arms. This means that two "fast sides" are also provided in the splicing device 7.

Two "fast sides" of a splicing unit according to the invention can also be achieved with a web unrolling device that only contains three positions for web rolls 21. This option is schematically illustrated in FIG. 4, with FIGS. 4*a*–4*d* indicating the respectively different operating phases.

The prerequisite for realizing two "fast sides" with only three web rolls is that the web delivered from each web roll 21 can be respectively transported to either intake 11 of the splicing unit 9. In the operating phase shown in FIG. 4*a*, the active web $\mathbf{5}_{akt}$ (in the following description, it is assumed for reasons of simplicity that the splicing device serves for splicing and transporting the cover strip 5 in the system according to FIG. 1) is delivered by the web roll 21 held in position I of the web unrolling device 13 and transported to the left intake 11 of the splicing unit 9. The web 5 to be spliced is delivered by the web roll 21 held in position II of the web unrolling device 13 and transported to the right intake 11 of the splicing unit 9. The web roll 21 held in position III represents the stand-by web roll.

Figures 4A, 4B, 4C, 4D, 4E, 4F:
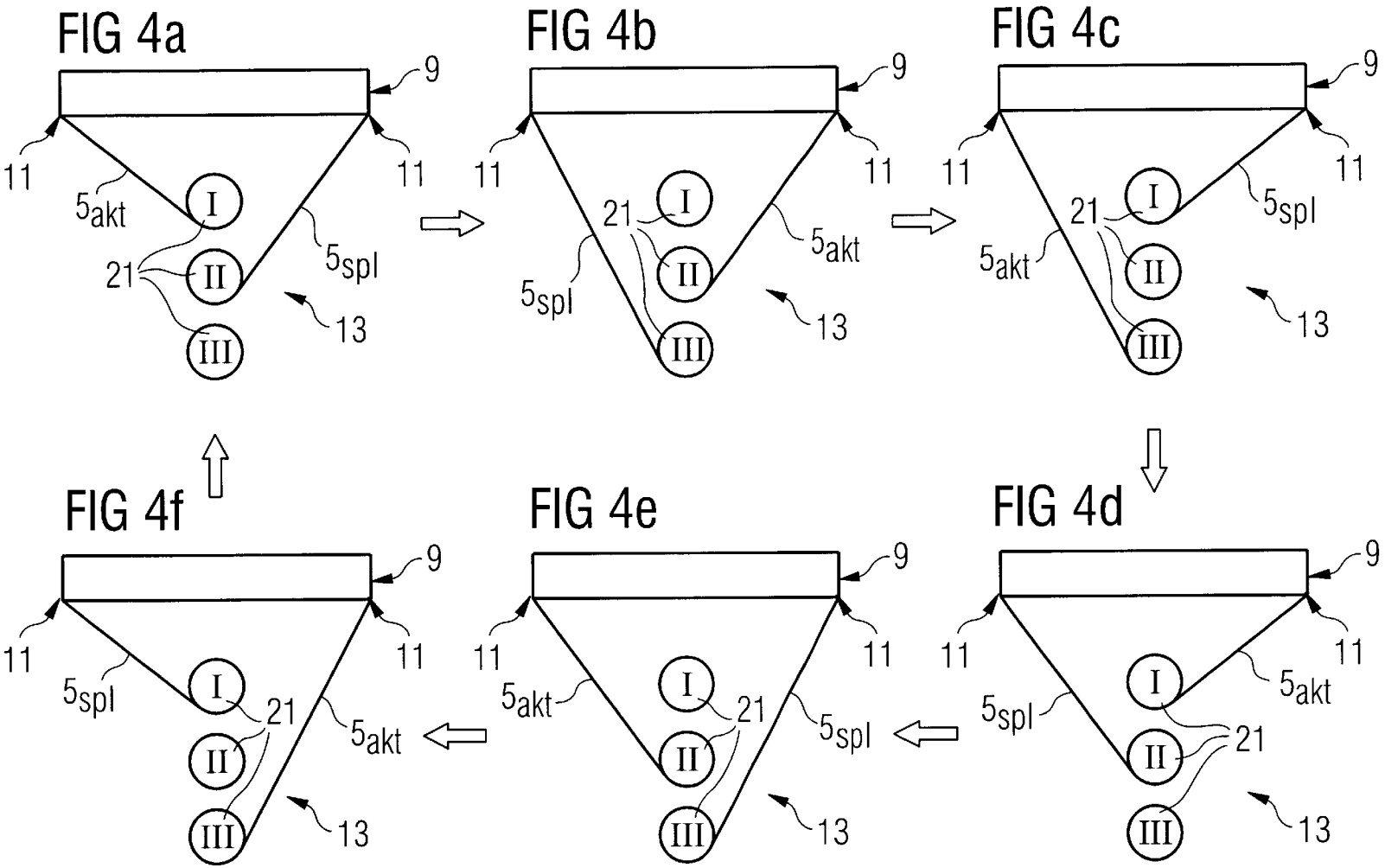
FIGS. 4*a–f* is a schematic representation of different operating phases of another embodiment of a splicing device according to the invention with a web unrolling device for three web rolls.

After the splicing process of the two webs supplied to the splicing unit 9 in FIG. 4*a* has been completed, the web roll 21 situated in position I becomes the stand-by web roll, and the web $\mathbf{5}_{spl}$ shown in FIG. 4*a* and unrolled from the web roll 21 held in position II becomes the active web $\mathbf{5}_{akt}$. The stand-by web roll 21 in FIG. 4*a*, which (if so required) was meanwhile replaced by a new web roll, becomes the web $\mathbf{5}_{spl}$ to be spliced in the operating phase shown in FIG. 4*b*.

The situation shown in FIG. 4*c* is accordingly reached after the splicing process for the webs supplied to the intakes 11 in FIG. 4*b*. In this operating phase, the web roll held in the position II represents the stand-by web roll that, if so required, can be replaced. The active web $\mathbf{5}_{akt}$ is delivered from the web roll held in position III in FIG. 4*c*, with the web $\mathbf{5}_{spl}$ to be spliced being delivered from the web roll held in position I.

Accordingly, the situations shown in FIGS. 4*d*–4*f* result because the web that is identified by the reference symbol $\mathbf{5}_{spl}$ in the previous figure is replaced by the active web $\mathbf{5}_{akt}$ in the respectively ensuing figure, with the respective web roll, from which the active web $\mathbf{5}_{akt}$ was previously delivered, becoming the stand-by web roll. The web $\mathbf{5}_{spl}$ to be spliced which is shown in the respectively ensuing figure is delivered from the web roll that represented the stand-by web roll in the previous figure.

After the splicing process for the webs $\mathbf{5}_{akt}$ and $\mathbf{5}_{spl}$ shown in FIG. 4*f*, the situation shown in FIG. 4*a* is reached again.

In the practical realization of such an embodiment of a splicing device according to the invention, the web rolls naturally need not necessarily be arranged vertically but may also be arranged horizontally adjacent to one another or in other positions relative to one another if corresponding deflection rollers are used.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A device for splicing webs, in particular paper webs for manufacturing corrugated cardboard, the device comprising:

(a) a splicing unit for preparing and splicing the rear end of an active web to the front end of a web to be spliced;

(b) the splicing unit containing one respective intake each for the active web and the web to be spliced; and (c) a web unrolling device for accommodating several web rolls;

(d) wherein the web unrolling device accommodates at least three web rolls such that a first of the three webs delivered from the web rolls can serve as the active web, a second web of the three webs can serve as the web to be spliced to the active web and the third web roll can be simultaneously replaced and/or prepared for the next splicing process, and wherein the web of a web roll which is situated in a given position of the web unrolling device can, depending on the respective requirements, be transported to either of the two intakes of the splicing unit.

2. The device according to claim 1 further comprising deflection rollers for transporting a web to either of the two intakes from any position.

3. The device according to claim 2 wherein the positions are arranged vertically one on top of the other, preferably central to the horizontal extent of the splicing unit.

4. The device according to claim 2 wherein the webs of two web rolls situated in two certain positions of the web unrolling device can be alternately transported to either of the two intakes of the splicing unit.

5. The device according to claim 1 wherein the positions are arranged vertically one on top of the other, preferably central to the horizontal extent of the splicing unit.

6. The device according to claim 1 wherein the webs of two web rolls situated in two certain positions of the web unrolling device can be alternately transported to only one of the two intakes of the splicing unit, with these positions preferably being arranged adjacent to the intake in question.

7. The device according to claim 6 wherein two splicing devices are essentially arranged adjacent to one another, each splicing unit contains an unrolling unit with two respective positions for one web roll, and one additional unrolling unit with two positions is provided between the splicing units, the position of this unrolling unit which is respectively situated adjacent to the splicing unit in question being assigned to this adjacent splicing unit.

8. A device for splicing each of at least two webs or partial webs for manufacturing corrugated cardboard by gluing together the at least two webs or partial webs, the device comprising:

(a) a splicing unit for preparing and splicing the rear end of an active web to the front end of a web to be spliced;

(b) the splicing unit containing one respective intake for the active web and the web to be spliced; and (c) a web unrolling device for accommodating several web roles, wherein, (d) the web unrolling device accommodates at least three web roles such that a first of the three web rolls delivered from the web unrolling device can serve as the active web, a second web roll of the three web rolls can serve as the web to be spliced to the active web and the third web roll can be simultaneously replaced and/or prepared for the next splicing process, and wherein the web of a web roll which is situated in a given position of the web unrolling device can, depending on the respective requirements, be transported to either of the two intakes of the splicing unit.

9. The device according to claim 8 further comprising deflection rollers for transporting a web to either of the two intakes from any position.

10. The device according to claim 9 wherein the webs of two rolls situated in two certain positions of the web unrolling device can be alternately transported to either of the two intakes of the splicing unit.

11. The device according to claim 8 wherein the positions are arranged vertically one on top of the other, preferably central to the horizontal extent of the splicing unit.

12. The device according to claim 9 wherein the positions are arranged vertically one on top of the other, preferably central to the horizontal extent of the splicing unit.

13. The device according to claim 8 wherein the webs of two web rolls situated in two certain positions of the web unrolling device can be alternately transported to only one of the two intakes of the splicing unit, with these positions preferably being arranged adjacent to the intake in question.

14. The device according to claim 13 wherein two splicing devices are essentially arranged adjacent to one another, each splicing unit contains an unrolling unit with two respective positions for one web roll, and one additional unrolling unit with two positions is provided between the splicing units, the position of this unrolling unit which is respectively situated adjacent to the splicing unit in question being assigned to this adjacent splicing unit.

* * * * *

UNITED STATES PATENT AND TRADEMARK OFFICE

CERTIFICATE OF CORRECTION

PATENT NO. : 6,575,217 B2 
DATED : June 10, 2003
INVENTOR(S) : Alfons Gnan and Edmund Bradatsch It is certified that error appears in the above-identified patent and that said Letters Patent is hereby corrected as shown below:

Column 7,
Lines 13 and 15, change “roles” to -- rolls --

Signed and Sealed this

Twelfth Day of August, 2003

JAMES E. ROGAN
*Director of the United States Patent and Trademark Office*